United States Patent [19]

Moll et al.

[11] 4,156,407

[45] May 29, 1979

[54] DRIVING ARRANGEMENT FOR INTERNAL COMBUSTION ENGINE AUXILIARIES IN THE FORM OF PUMPS

[76] Inventors: Hans H. Moll; Hans W. Moll, both of Sebastianstrasse 27 g, 8900 Augsburg 1, Fed. Rep. of Germany

[21] Appl. No.: 770,352

[22] Filed: Feb. 22, 1977 (Under 37 CFR 1.47)

[30] Foreign Application Priority Data

Feb. 23, 1976 [DE] Fed. Rep. of Germany ..... 2607342
Feb. 23, 1976 [DE] Fed. Rep. of Germany ..... 2607343

[51] Int. Cl.[2] ..... F01P 7/08; F01P 7/16; F01P 5/10

[52] U.S. Cl. ..... 123/41.49; 123/196 AB; 123/41.33; 123/41.46; 123/198 C

[58] Field of Search ..... 123/196 CP, 196 R, 198 DA, 123/198 C, 41.46, 41.44, 41.02, 41.05, 41.12, 41.51, 41.33, 41.49, 196 AB

[56] References Cited

U.S. PATENT DOCUMENTS

| | | | |
|---|---|---|---|
| 1,662,723 | 3/1928 | Snow | 123/41.46 |
| 2,357,606 | 9/1944 | Nutt | 123/196 R |
| 3,112,012 | 11/1963 | Hoch | 123/196 R |
| 3,162,998 | 12/1964 | Williams | 123/41.33 |
| 3,367,446 | 2/1968 | Higgins | 123/196 R |

FOREIGN PATENT DOCUMENTS

| | | | |
|---|---|---|---|
| 1237044 | 10/1959 | France | 123/41.02 |

OTHER PUBLICATIONS

"Heat Exchanger Service Manual," Harrisoh Radiator Division, General Motors Corporation, 3-1944, p. 11.

*Primary Examiner*—Charles J. Myhre
*Assistant Examiner*—Jeffrey L. Yates
*Attorney, Agent, or Firm*—Scully, Scott, Murphy & Presser

[57] ABSTRACT

An arrangement for driving the oil and water pumps of an internal combustion engine in which the pumps are driven independently of the engine's speed. In one arrangement the oil pump is activated prior to starting the engine to provide adequate lubrication to the engine during the starting operation. The activation of the water pump may be controlled by the temperature of the engine such that it is not needlessly driven when the engine is cold.

1 Claim, 2 Drawing Figures

Figure 1:
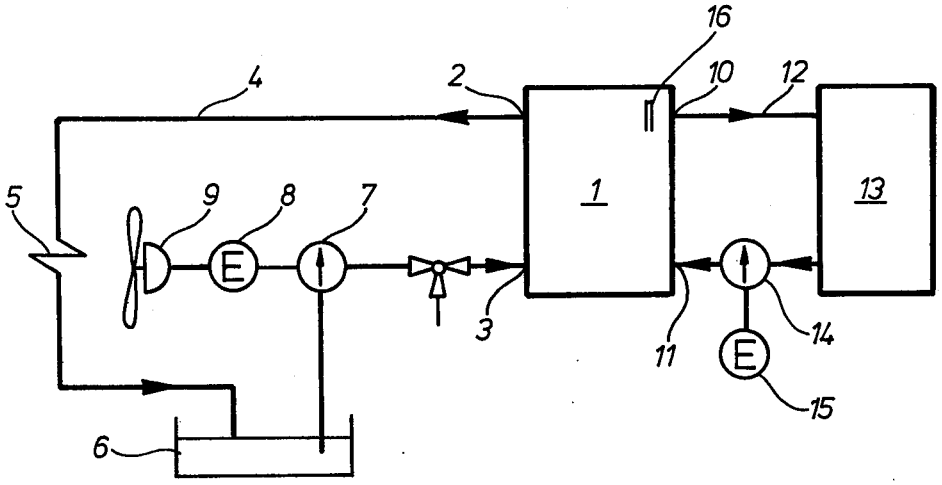

DRIVING ARRANGEMENT FOR INTERNAL COMBUSTION ENGINE AUXILIARIES IN THE FORM OF PUMPS

Among the auxiliaries required by internal combustion engines are pumps to deliver cooling liquid, where an oil pump supplies the engine bearings with lubricating oil for their lubrication and cooling while a water pump serves to circulate the cooling water. Conventionally, the practice has been to date to drive the oil pump and the water pump in relative dependence on the engine crankshaft, such that a pulley on the crankshaft is coupled to a pulley on the pump impeller shaft by means of a V-belt. The resulting fixed relation of pump operation to engine operation is embarrassed by a number of disadvantages; for one, that the oil pump will not be motivated until the engine has fully come into action. This involves a disadvantage in that, among others, at the start of its operation or when it is running up to normal speed the engine will run in bearings which cannot be supplied with lubricating oil from outside. This may cause the bearings to run dry or surely to operate at unfavorable conditions conducive to wear.

In a broad aspect the present invention eliminates these disadvantages to ensure that the engine bearings are always supplied with lubricating oil in the best possible fashion, or broadly speaking the present invention provides an arrangement for impelling the engine pumps such that the supply of coolant is optimum and independent of engine operation. It is a particular object of the present invention to provide an arrangement where the oil pump of an internal combustion engine is driven independently of the crankshaft of this engine by means of a separate motor which may optionally be electric or hydraulic. This arrangement applies equally to the cooling water pump.

Seen with reference to the oil pump now, this arrangement ensures invariably optimum supply of lubricating oil to the engine bearings independently of engine operation. This holds true for both the duration and the intensity of the supply of lubricating oil to the bearings. More particularly, the supply of lubricating oil can at will commence before the engine starts running, and it can be continued for a certain time after the engine has stopped running. Accordingly, the supply of oil sets in already before load is imposed on the bearings, and the lubricating oil still carries heat away from the bearings even after the engine has come to rest. This considerably reduces the bearing wear commonly associated with internal combustion engines of conventional arrangement. While the engine is running the speed of the pump remains variable freely and independently of engine speed. This affords an advantage in that the speed of the oil pump can be set high enough also at low engine speeds to fully ensure the supply of the bearings with oil. It naturally follows that a relatively small-size pump will be sufficient to achieve adequate results. The additional investment for an oil pump driven independently of the crankshaft is thus held within reasonable limits, and the technical achievement stands in economically tenable relation to the cost incurred. Alternatively, the pump speed can be varied at constant engine speed, as may be desirable when it is intended to deliver a constant amount of oil or to maintain the oil pressure at a constant level. This provides a tool for controlling the oil temperature in the bearings or making up for differences in oil viscosity arising from variations in the oil temperature. Accordingly, use can now be contemplated of a reasonably priced single-grade oil throughout the year where before the use of expensive multigrade oils had been inevitable or where a single-grade oil had to be replaced with another single-grade oil, as when changing from summer to winter operation.

The present invention provides a special advantage in operation also with regard to the oil change. Customarily the oil change has been effected by removing an oil drain plug in the bottom-most portion of the lubrication system to allow the old oil and with it the contaminations trapped in the sump to escape through the open drain port. This if nothing else is an onerous job in that for an oil change the vehicle normally needs raising on a car lift for access to the oil drain. In the arrangement of the present invention, however, the oil system can be pumped empty from above with much greater ease in that the oil pump is driven by a separate motor also with the vehicle engine standing still.

The problems are comparable for the cooling water pump of a water-cooled internal combustion engine. This pump, as is the oil pump, is conventionally driven in fixed relative dependence on the engine crankshaft. With the conventional arrangement, therefore, proper cooling of the internal combustion engine necessitates the use of a thermostat to control the cooling water requirement. This thermostat spells added complexity of construction, additional potential malfunctions, and energy-wasting resistance to the flow of cooling water. If the cooling water pump is driven independently of the crankshaft, the separate pump motor can be automatically controlled to achieve an effect comparable to thermostat control, yet without thermostat, so that even in the absence of other benefits the operational reliability is improved without complicating the construction and the pump is reduced in size.

It would seem especially important that at cold starts the cooling water pump should initially remain out of action. This will particularly allow the combustion space of the internal combustion engine to heat rapidly to alleviate wear, to benefit the composition of the exhaust gas and to cut fuel consumption by shortening the warm-up time. It will here be useful to control the cut-in point and the speed of the water pump drive by means of a thermal probe in the cylinder head.

From the installation aspect the water pump can now be accommodated at a location which regarding the mechanics of flow would be more favorable than that dictated by a conventionally crankshaft-driven water pump. The inventive concept also embraces arrangements where the water pump and the radiator fan, the latter now often being driven independently of crankshaft speed by an electric motor, are driven by a common motor.

It would likewise seem important that the circulation of cooling water can be continued after the engine is shut down hot, so as to prevent vapor lock in the cylinder head after, e.g., slow drives over mountain passes.

Accordingly, when the cooling water pump is driven independently of the crankshaft of the internal combustion engine, the ensuing problems and advantages very well compare with those arising when the oil pump is driven independently of the crankshaft of the internal combustion engine.

As regards the arrangement of the water pump a special effect will be achieved if the pump is located between the radiator and a short-circuit line connecting the cooling water inlet to the cooling water outlet.

A short-circuit line of this description is in itself common practice. When the engine is running up and still cold, the short-circuit line connects the engine cooling water outlet directly to the engine cooling water inlet. Then when the operating temperature of the internal combustion engine is gradually attained, the short-circuit line is closed off and the cooling water passes through the radiator on its way from the engine cooling water outlet to the engine cooling water inlet. The changeover from the short-circuit line to the radiator is effected by means of a three-way changeover valve which is automatically controlled by means of a thermostat in the cooling water outlet of the internal combustion engine. The water pump is arranged between the three-way valve and the cooling water inlet of the engine, so that it operates from the time the engine is started to circulate a constant amount of cooling water through the engine, where the water merely returns to the engine uncooled in the short-circuit mode and cooled in the radiator in the normal mode. This effect, now, is considerably improved when in the starting phase of the engine no cooling water at all is circulated through the engine. In the arrangement of the present invention, where the cooling water pump is driven independently of the internal combustion engine, the cooling water pump is prevented from operating in the starting phase of the internal combustion engine.

A comparable effect can be achieved, however, also by arranging the pump such that independently of its motor it will alone by virtue of its arrangement refrain from circulating water through the engine, or that it will at most circulate water only through a short-circuited radiator. When the pump is arranged between the cooling water outlet of the radiator and said three-way valve and when, being driven separately as it is, it is prevented from operating in the starting phase of the internal combustion engine, the effect will be the same as if it were arranged conventionally between the three-way valve and the cooling water inlet of the engine. However, when thermostat control is provided with the water pump in constant action as with conventional arrangements, the cooling water is circulated from the radiator outlet to the radiator inlet through the short-circuit line, and the engine will rapidly attain operating temperature exactly as if the operating pump were inactive, because the cooling water in the engine does not enter into circulation.

Figure 2:
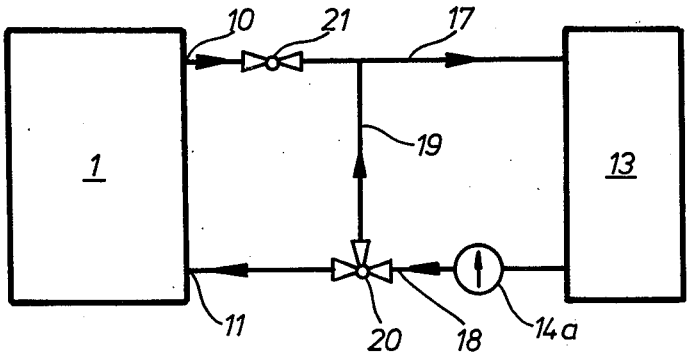

The accompanying drawing illustrates two embodiments of the invention in the form of block diagrams, in which FIG. 1 is an arrangement where the water pump and the oil pump alike have drive provisions of their own, while FIG. 2 is an arrangement for the water pump, where it is immaterial exactly what form the water pump drive would take.

Internal combustion engine 1 exhibits an outlet 2 and an inlet 3 for the lubricating oil. Arranged between the lubricating oil outlet 2 and the lubricating oil inlet 3 is a connecting line 4 incorporating an oil cooler 5 for cooling the lubricating oil. Lubricating oil line 4 is interrupted by an oil sump 6 in which the contaminations in the oil are allowed to set. The oil is taken from the oil sump by means of an oil pump 7 and is directed to the oil inlet 3 of the internal combustion engine 1. The oil pump is driven by its own electric motor 8 which may simultaneously drive also the fan 9 of the oil cooler 5. The speed of the electric motor is variable from zero to a maximum operating speed.

The ducting of the cooling water from the water outlet 10 of the water-cooled internal combustion engine 1 to its cooling water inlet is effected by means of a cooling water line 12 with a radiator 13 cut into it. The cooling water is circulated by means of a cooling water pump 14 in the cooling water return flow. The cooling water pump is driven by an electric motor 15 variable between zero and a maximum speed.

Before the internal combustion engine 1 is started, electric motor 8 is brought into action to circulate the lubricating oil and supply the bearings of the internal combustion engine with lubricating oil. It is only when the lubricating oil is in full circulation and the engine bearings are supplied with lubricating oil that the internal combustion engine 1 is started. When the internal combustion engine is being started, electric motor 15 initially remains out of operation, so that no cooling water of engine 1 is being circulated. Combustion spaces and cylinder heads of internal combustion engine 1 are allowed to attain optimum operating temperature at a relatively fast pace. It is only when the optimum operating temperature is achieved or exceeded that electric motor 15 is brought into action. Circulation of the cooling water now begins. The cooling water gains temperature in the water spaces of internal combustion engine 1, is cooled in radiator 13 and so cooled returns to internal combustion engine 1 through inlet 11. The speed of electric motors 8 and 15 is varied in response to operating conditions, manually or automatically by means of special control elements. Electric motor 15, e.g., may be activated by means of a temperature probe 16 which inserted in the cylinder head of the internal combustion engine starts the motor when the optimum operating temperature is exceeded to cause circulation of cooling water through the radiator 13 and the entire cooling system. With the arrangement of FIG. 2 the effect is comparable as regards the cooling of engine 1. This is basically a conventional arrangement with the cooling water outlet 10 unchanged, the cooling water inlet 11 likewise unchanged, and with the radiator 13. Normally, a short-circuit line is arranged between the cooling water incoming end 17 and the cooling water return end 18, with a three-way valve 20 allowing passage of the cooling water through the short-cut or the full cooling water circuit. Arranged still in conformance to conventional arrangements between the cooling water outlet 10 and the short-circuit line 19 is a thermostat 21. In departure from conventional arrangements, however, the water circulating pump **14*a* is arranged in the cooling water return end 18 between the radiator 13 and the three-way valve 20. When use is made of a thermostat in this arrangement, the cooling water pump 14*a* may be the conventional, continuously driven type of water pump. Before the operating temperature of the internal combustion engine is attained, however, the thermostat positions the three-way valve such that the cooling water is circulated only between the radiator 13 and the return line 19. The cooling water contained in the cooling water spaces of internal combustion engine 1 does not enter into circulation. The internal combustion engine is thus allowed to reach optimum operating temperature at a very fast rate. It is only when the optimum operating temperature is exceeded and this is sensed by the thermostat that the thermostat 20 repositions the three-way valve such that the circulation of cooling water now fully includes the internal combustion engine 1 and the radiator 13. Regardless of conventional thermostat control, then, the effect relative to the cooling water circuit is the same as in the arrangement of FIG. 1 where the water pump 14 is prevented from operating. Yet in the arrangement of FIG. 2, pump 14***a* can optionally be driven by its own electric or other motor, although this arrangement also admits of conventionally driving the pump in relative dependence on the crankshaft of engine 1. This combination may prove desirable when retrofitting the engine or otherwise.

What is claimed is:

1. An internal combustion engine having a cooling water system for cooling the cylinder head of the internal combustion engine including a cooling water pump, a drive motor for the cooling water pump, and a temperature sensor in the cylinder head of the internal combustion engine for actuating the drive motor for the cooling water pump in response to the detection of a predetermined temperature in the cylinder head, and a cooling oil system for cooling and lubricating the bearings of the internal combustion engine including a cooling oil pump, a drive motor for the cooling oil pump, an oil cooler for reducing the temperature of the cooling oil, and a fan for directing air onto said cooler, said drive motor for the cooling oil pump also being coupled to drive the fan for the oil cooler, whereby the motor for the oil pump may be actuated to cause circulation of oil through the bearings of the internal combustion engine for lubrication thereof prior to starting of the internal combustion engine, and during operation of the engine the temperature sensor in the cylinder head actuates the drive motor for the cooling water pump in response to the detection of a predetermined temperature in the cylinder head.

* * * * *